US005978978A

United States Patent [19]

Claffey

[11] Patent Number: 5,978,978

[45] Date of Patent: Nov. 9, 1999

[54] METHOD AND APPARATUS FOR SWIMMING POOL CONSTRUCTION

[76] Inventor: Brian P. Claffey, 1651 Choteau Cir., Grapevine, Tex. 76051

[21] Appl. No.: 09/033,458

[22] Filed: Feb. 28, 1998

[51] Int. Cl.[6] ..... E04H 4/00

[52] U.S. Cl. ..... 4/506; 4/496

[58] Field of Search ..... 4/506, 496, 507, 4/488, 490; 138/89, 90, 91, 92, 94; 73/40, 40.5 R, 37

[56] References Cited

U.S. PATENT DOCUMENTS 2,886,067 5/1959 Maxwell et al. ..... 138/90

3,194,466 7/1965 Davis ..... 138/90

5,224,516 7/1993 McGovern et al. ..... 138/90

5,864,897 2/1999 Ross ..... 4/496

*Primary Examiner*—David J. Walczak

*Attorney, Agent, or Firm*—Crutsinger & Booth

[57] ABSTRACT

An open water circulation system receptacle in a swimming pool is blocked with a cylindrical plug to prevent entry of unwanted detritus during pool construction and circulation system testing. The cylindrical plug is provided with removable longitudinal interior portions to permit fitting of piping into the receptacle for test connections, with the cylindrical plug in place.

13 Claims, 3 Drawing Sheets

METHOD AND APPARATUS FOR SWIMMING POOL CONSTRUCTION

TECHNICAL FIELD

The present invention relates to the field of swimming pool construction and more particularly, to apparatus for facilitating post construction clean-up and preventing introduction of debris into the water circulation system.

BACKGROUND OF THE INVENTIONS

Prior to Word War II, the vast majority of swimming pools were public pools or private group owned facilities. Since that time, and mostly in the past thirty years, residential swimming pools have become increasingly popular so that the number of swimming pools in the United States has grown dramatically. Swimming pools were formerly made with forms and poured concrete but formless costruction, wherein the concrete is sprayed in place over a pre-assembled matrix of reinforcing bar, has reduced both the cost and construction time. Where once, virtually every pool had required a custom made circulation and filtration system, packaged units became available in a range of sizes, so as to allow additional savings. These economies, together with price competition among the installers, served to accelerate growth of the swimming pool industry. Inasmuch as the need for routine maintenance tends to discourage prospective pool buyers, maturation of the industry has been marked by the advent of labor saving devices such as automatic surface skimmers and self operating pool vacuums.

Maturation of the industry is accompanied by more intense competition among the pool installers. In a typical scenario, a pool installation company will install the plumbing and pool equipment themselves, but subcontract the specialized construction phases, excavation, re-bar placing and tying, concrete spraying, tile work, plastering and decking to subcontractors. Construction methods are virtually standardized in the industry and often, the same subcontractors will work for several pool installation companies. As a result, the cost basis for similar products of similar quality is much the same to all installers and each of them is driven to control internal operating costs and shave profit margins in order to remain competitive. Thus, the installation of plumbing and pool equipment, sub-contractor supervision and quality control are the factors which management can control. Since sub-contractor supervision is purely a management skill, to which all have equal access, the labor of plumbing and pool equipment installation and the efficacy of quality control are the only areas where a competitive advantage may be achieved. Therefore, there is a continuing need for refining and improving these operations.

Skimmer, pool drain and other plumbing receptacles are open and difficult to protect from the entry of dirt, concrete and other debris during pool construction and water circulation system testing. The conventional practice of stuffing these receptacles with an empty sack does not resolve the debris problem. As a final step after construction and testing, the receptacles must be laboriously cleaned out by hand. Particularly at this time, there is a real risk of gravel, mortar, concrete or stones falling into the plumbing. Swimming pool pumps have a limited tolerance for ingesting such solids, and impeller damage or worse might result. An unfortunately sized rock might block a line at the first elbow it couldn't pass for an even worse and more expensive scenario.

Therefore, the first object of the present invention is to provide an improved method and apparatus for the installation of plumbing and pool equipment so as to produce a more reliable work product by eliminating the potential for debris in the circulation system so that less labor and expense is incurred for correcting deficiencies in the completed pool installation. A second object is that this improved installation method and apparatus also reduce the total amount of labor required on the part of the pool installing company.

SUMMARY OF THE INVENTIONS

The present inventions contemplate improved methods and apparatus for installing drains, skimmers and other water handling system components in a swimming pool. Practice of the present inventions uses some steps and apparatus well known in the swimming pool construction arts and therefore, not the subject of detailed discussion herein.

In a preferred embodiment of the present inventions, a prtective cylindrical plug member is fitted into the open plumbing receptacles during pool construction and circulation system testing so that the potential for entry of unwanted debris into the receptacles is eliminated. In this preferred embodiment, the plug member is provided with interior portions that can be removed to accommodate a plurality of pipes extending out of the receptacles for circulation system testing.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
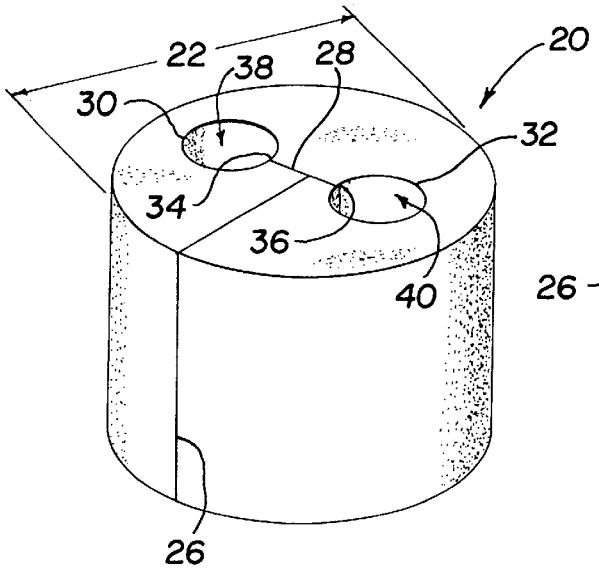
FIG. 1 shows a first preferred embodiment of the plug member of the present inventions.

The embodiments shown above and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

Figure 2:
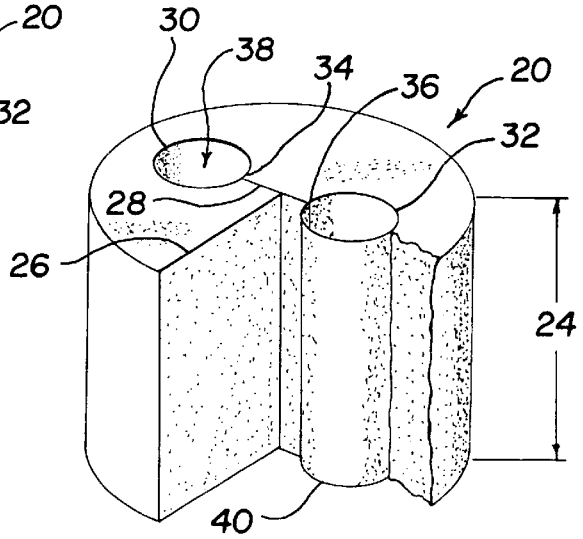
FIG. 2 shows the plug member of FIG. 1 with a one-quarter section broken out to reveal internal details.

FIGS. 1–4 are illustrative of forms expressing preferred embodiments of the present inventions. Cylindrical plug member 20, as shown in FIGS. 1 and 2 is preferably made of a light weight open or closed cell foam material but may be made of any easily handled, inexpensive material. The resilience of foam type materials has a particular benefit in facilitating insertion and removal of cylindrical plug member 20 as will be further explained below. The dimensions of diameter 22 and length 24 of plug member 20 are determined by the specific usage of the part but in any case are such as to provide a close fit. Longitudinal cut 26, such as may be made by a hot wire cutter or a laser, is seen to run the length of cylindrical plug member 20, from the exterior to the approximate center thereof. Transverse cut 28 intersects the inner terminus of longitudinal cut 26 and extends either way at approximate right angles to circular cuts 30 and 32. Circular cuts 30 and 32, except for short uncut sections 34 and 36, describe the periphery of circular cross-section interior portions 38 and 40 respectively. FIG. 2, with a one-quarter section broken out, shows that all cuts 26, 28, 30 and 32, extend through the full length 24 of cylindrical plug member 20 and further illustrates how uncut sections 34 and 36 serve to retain interior portions 38 and 40 in place. Uncut sections 34 and 36 however, are readily torn for removal of interior portions 38 and 40. In an alternative embodiment, wherein all cuts are made by a laser, longitudinal cut 26 and transverse cut 28 may be dispensed with, while completing circular cuts 30 and 32 so as to eliminate the short uncut sections 34 and 36. Interior portions 38 and 40 are then retained by friction, but can be readily removed when appropriate.

Figure 3:
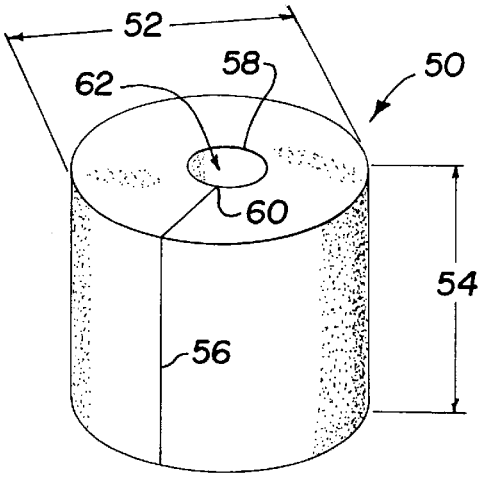
FIG. 3 shows a second preferred embodiment of the plug member of the present inventions.

FIG. 3 shows a second preferred embodiment of the present invention as plug member 50. The dimensions of diameter 52 and length 54 of plug member 50 are again determined by the specific usage of the part but in any case are such as to provide a close fit. Longitudinal cut 56 may be made by a hot wire cutter or a laser and runs the length of cylindrical plug member 50, from the exterior to circular cut 58. Circular cut 58, except for short uncut section 60, describes the periphery of circular cross-section interior portion 62, which is removable in the manner previously described.

Figure 4:
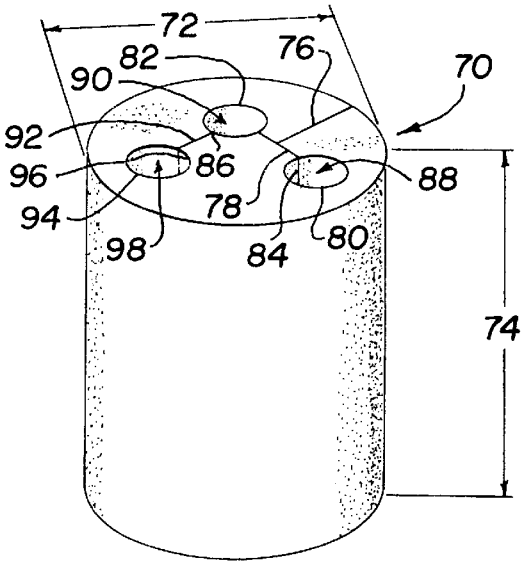
FIG. 4 shows a third preferred embodiment of the plug member of the present inventions.

FIG. 4 shows a third preferred embodiment of the present invention as plug member 70. The dimensions of diameter 72 and length 74 of plug member 70 are determined by the specific usage of the part but again, are such as to provide a close fit. Longitudinal cut 76 runs the length of cylindrical plug member 70, from the exterior to intersect transverse cut 78. Transverse cut 78 extends either way at approximate right angles to circular cuts 80 and 82, which leave short uncut sections 84 and 86, but otherwise describe the periphery of circular cross-section interior portions 88 and 90 respectively. Second transverse cut 92 extends from the end of circular cut 82 to a third circular cut 94, complete except for short uncut section 96, so as to provide third circular cross-section interior portion 98. Interior portions 88, 90 and 98 are removable in the manner previously described.

Figure 5:
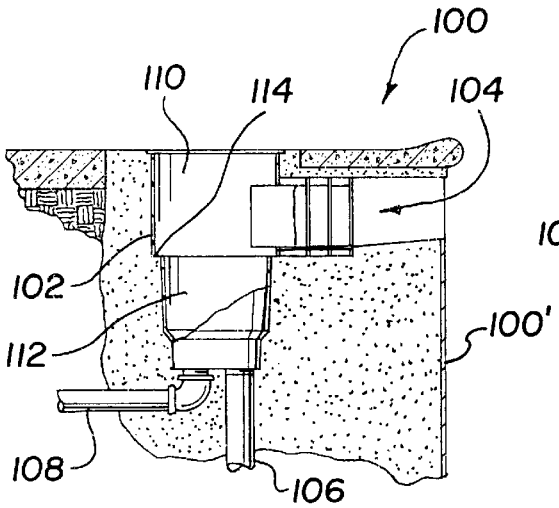
FIG. 5 is a vertical section view of a typical poolside skimmer installation.
Figure 6:
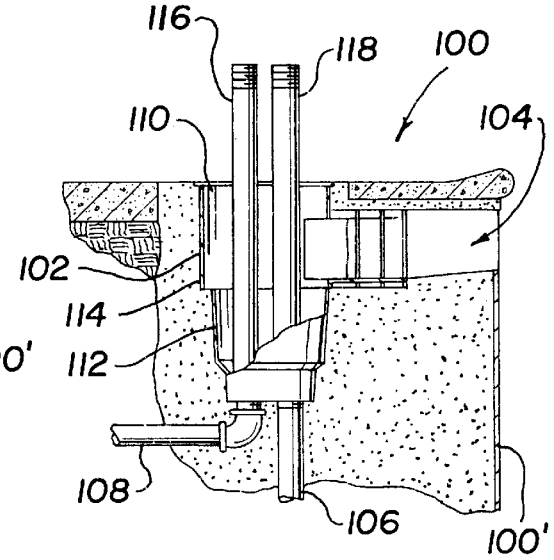
FIG. 6 is a vertical section view of the poolside skimmer installation of FIG. 5 with pipe extensions installed for water circulation system testing purposes.

FIGS. 5 and 6 are vertical cross-section views of poolside skimmer installation 100 in swimming pool 100'. The particular unit shown is an automatic surface skimmer receptacle 102 of a type well known in the art, and may be equipped with a safety or equalizing valve (unshown) for diverting flow from weir 104 to main drain or equalizing line 106 so as to provide uninterrupted flow to pump connecting line 108. Receptacle 102 comprises upper chamber 110 and basket chamber 112. In the working configuration of poolside skimmer installation 100, intermediate shoulder 114 supports a skimmer basket that is not present in this view.

In FIG. 6, pipes 116 and 118 are stubbed into receptacle 102 so as to provide accessible connections to the drain or equalizing line 106 and pump connecting line 108 respectively for test purposes.

Receptacle 102 is open and difficult to protect from the entry of dirt and debris during construction and testing. The conventional practice of stuffing receptacle 102 with an empty sack or whatever is available does not resolve the debris problem. As a final step after testing, receptacle 102 must be laboriously cleaned out by hand, and there is a real risk of gravel or stones falling into the plumbing if care is not taken. Swimming pool pumps have a limited tolerance for ingesting solids such as rocks and impeller damage or worse might result. An unfortunately sized rock might block a line at the first elbow it couldn't pass through for an even worse, more expensive scenario.

Figure 7:
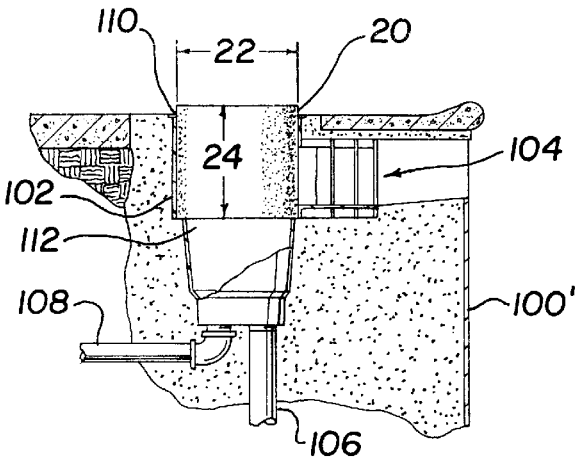
FIG. 7 shows the poolside skimmer of FIG. 5 with as it appears with application of the present inventions.

As shown in FIG. 7, diameter 22 of cylindrical plug member 20 of FIG. 1 is sized to provide a tight fit in upper chamber 110 and length 24 is made to fill the depth of chamber 110, above the top of receptacle 102. Thus, with cylindrical plug member 20 in place, the interior of receptacle 102 is positively protected from the entry of debris.

Figure 8:
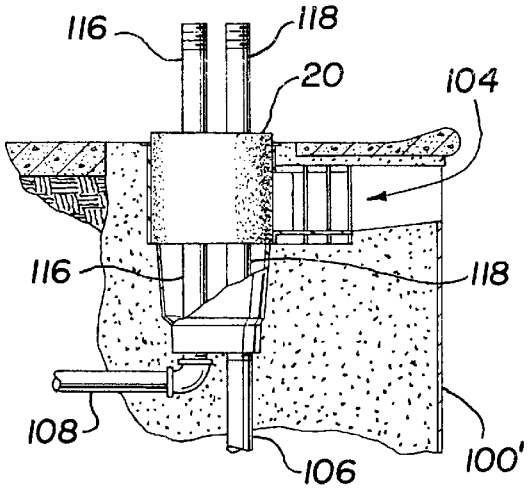
FIG. 8 shows the poolside skimmer of FIG. 6 with as it appears with application of the present inventions.

Moreover, as shown in FIG. 8, removal of interior portions 38 and 40 (not shown in this view) allows placement of cylindrical plug member 20 with testing pipes 116 and 118 threaded into the bottom of receptacle 102. Thus, receptacle 102 can be protected throughout pool construction and circulation system testing, so that no labor is required for clean-out and the risk of rocks in the circulation system is eliminated.

Figure 9:
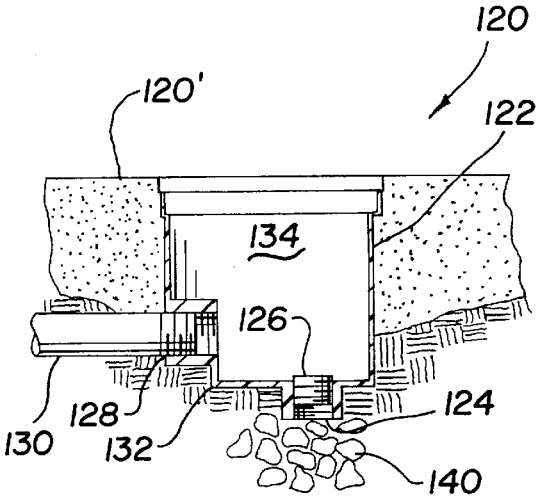
FIG. 9 is a vertical section view of a typical pool drain inlet installation.
Figure 10:
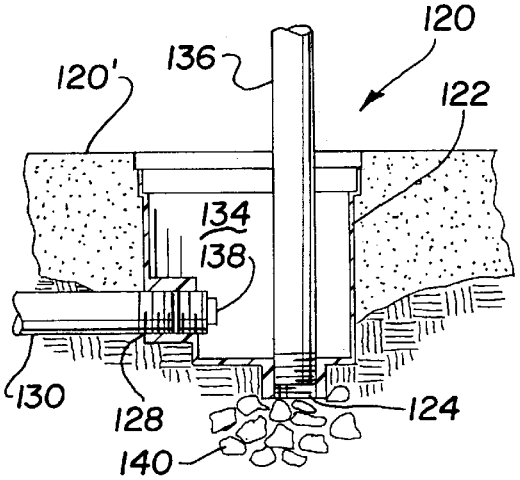
FIG. 10 is a vertical section view of the pool drain inlet installation of FIG. 9 with a pipe extension installed for water system testing purposes.

FIGS. 9 and 10 are vertical cross-section views of main drain installation 120 in swimming pool bottom 120'. Drain receptacle 122 is of a type well known in the art and provides pipe port 124 for draining pool water directly into gravel bed 140 when pipe plug 126 is removed. Also provided is pipe port 128 with drain line 130 connected to the unshown circulation pump. Pipe ports 124 and 128 extend from the lower portion 132 of receptacle 122, which also includes chamber 134. In FIG. 10, pipe plug 126 is removed and pipe 136 is stubbed into pipe port 124 of receptacle 122 to extend up through chamber 134 so as to provide relief for ground water pressure. Pipe 130 is plugged with plug 138 for purposes of pressure testing the system. Thus, receptacle 122, like various other plumbing receptacles in the water circulation system, is open and difficult to protect from the entry of dirt and debris during pool construction and circulation system testing.

Figure 11:
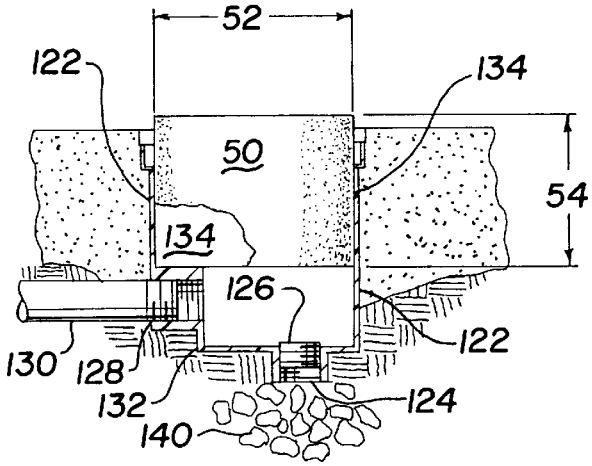
FIG. 11 shows the pool drain inlet installation of FIG. 9 with as it appears with application of the present inventions.
Figure 12:
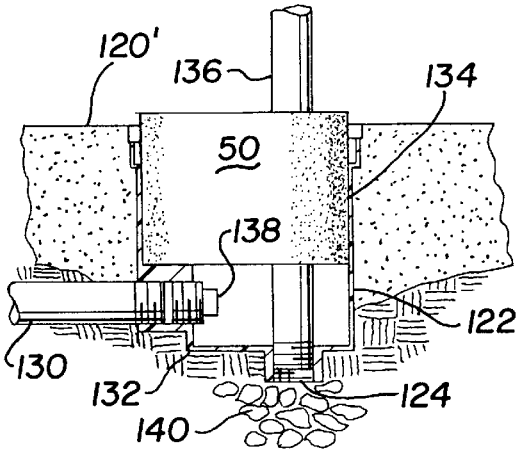
FIG. 12 shows the pool drain inlet installation of FIG. 10 with as it appears with application of the present inventions.

As shown in FIGS. 11 and 12, diameter 52 of plug member 50 of FIG. 3 is sized to provide a tight fit in chamber 134 and length 154 is made to fill the depth of chamber 134, above the top of receptacle 122. Thus, with plug member 50 in place, the interior of receptacle 122 is positively protected from the entry of debris. Moreover, as in the manner shown in FIG. 8, removal of interior portion 62 (not shown in this view) allows placement of plug member 50 with pipe 136 threaded into port 124. Thus, receptacle 122 can be protected throughout pool construction and circulation system testing, so that no labor is required for clean-out and the risk of rocks in the circulation system is eliminated.

Other receptacles may have a need for installation of three test pipes so as to require the use of a plug similar to plug member 70 of FIG. 4 in the same manner as described above.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for blocking open receptacles in a swimming pool water circulation system during pool construction and circulation system testing comprising:

a cylindrical plug having a longitudinal axis, with the exterior of said plug being transversely sized to fit closely within said receptacle;

at least one cut parallel to said longitudinal axis and through the length of said cylindrical plug so as to create at least one longitudinal, and optionally removable, interior portion having a substantially circular cross-section;

at least one temporary test pipe adapted to be installed within said receptacle to facilitate testing the water circulation system; and means for removal of said at least one interior portion to accommodate the installation of said at least one test pipe when said cylindrical plug is fitted within said receptacle.

2. Apparatus for blocking open receptacles in a swimming pool water circulation system according to claim 1 wherein said cylindrical plug is made of a resilient material.

3. Apparatus for blocking open receptacles in a swimming pool water circulation system according to claim 1 wherein provision is made for a plurality of longitudinal and optionally removable interior portions.

4. Apparatus for blocking open receptacles in a swimming pool water circulation system according to claim 1 wherein said means for removal of said at least one interior portion is tearing an uncut section of the circular periphery thereof.

5. Apparatus for blocking open receptacles in a swimming pool water circulation system according to claim 1 wherein said means for removal of said at least one interior portion from said cylindrical plug is overcoming frictional forces therebetween.

6. Apparatus for blocking open receptacles in a swimming pool water circulation system according to claim 1 wherein said at least one cut passes through the exterior of said cylindrical plug.

7. Apparatus for blocking open receptacles in a swimming pool water circulation system during pool construction and circulation system testing comprising:

a cylindrical plug having a longitudinal axis, said plug being transversely sized to fit closely within said receptacle;

at least one cut parallel to said longitudinal axis and through the length of said cylindrical plug so as to provide for at least one longitudinal and optionally removable, round cylindrical interior member;

at least one temporary test pipe adapted to be installed within said receptacle to facilitate testing the water circulation system; and means for removal of said at least one interior portion to accommodate the installation of said at least one test pipe when said cylindrical plug is fitted within said receptacle.

8. Apparatus for blocking open receptacles in a swimming pool water circulation system according to claim 7 wherein said cylindrical plug is made of a resilient material.

9. Apparatus for blocking open receptacles in a swimming pool water circulation system according to claim 7 wherein provision is made for a plurality of longitudinal and optionally removable, round cylindrical interior portions.

10. Apparatus for blocking open receptacles in a swimming pool water circulation system according to claim 7 wherein said means for removal of said at least one interior portion is tearing an uncut section of the round periphery thereof.

11. Apparatus for blocking open receptacles in a swimming pool water circulation system according to claim 7 wherein said means for removal of said at least one interior portion from said cylindrical plug is overcoming frictional forces therebetween.

12. Apparatus for blocking open receptacles in a swimming pool water circulation system according to claim 7 wherein said at least one cut passes through the exterior of said cylindrical plug.

13. A method for blocking an open receptacle in a swimming pool water circulation system during pool construction and circulation system testing comprising the steps of:

fitting a temporary cylindrical plug longitudinally into the receptacle;

removing a longitudinal interior portion of the cylindrical plug to provide access for fitting a test pipe into the receptacle;

fitting a test pipe, through the access so provided, into the receptacle;

completing pool construction and circulation system testing; and removing the cylindrical plug and test pipe.

* * * * *